US005240436A

United States Patent [19]

Bradley et al.

[11] Patent Number: 5,240,436

[45] Date of Patent: Aug. 31, 1993

[54] BNC-RJ CONVERSION CONNECTOR

[75] Inventors: James D. Bradley, Mound; Zakhary Bluband, Plymouth, both of Minn.

[73] Assignee: ADC Telecommunications, Inc., Minneapolis, Minn.

[21] Appl. No.: 854,377

[22] Filed: Mar. 19, 1992

[51] Int. Cl.[5] ..... H01R 25/00

[52] U.S. Cl. ..... 439/654; 439/620; 439/676

[58] Field of Search ..... 439/638-640, 439/651-655, 676, 620, 404, 578-585, 675

[56] References Cited

U.S. PATENT DOCUMENTS 4,559,421 12/1985 Zapke et al. ..... 439/638
4,648,682 3/1987 Tubbs ..... 439/638
4,693,537 9/1987 Dinsmore et al. ..... 439/404
5,073,123 12/1991 Birch et al. ..... 439/188
5,092,785 3/1992 Chen ..... 439/638
5,108,315 4/1992 Vogl et al. ..... 439/651

*Primary Examiner*—David L. Pirlot
*Attorney, Agent, or Firm*—Merchant, Gould, Smith, Edell, Welter & Schmidt

[57] ABSTRACT

An electrical connector is disclosed having a housing extending from a first connection end to a second connection end. The first connection end is connectable to a BNC connector. The second connection end includes an RJ jack for receiving an RJ twisted pair plug. Internal circuitry is provided for connecting the coax connector end to the RJ connector end while providing desired impedance matching.

3 Claims, 6 Drawing Sheets

BNC-RJ CONVERSION CONNECTOR

BACKGROUND OF THE INVENTION

1. Field of the Invention

This invention pertains to apparatus for affecting electrical connection between two sets of conductors. More particularly, this invention pertains to a connector apparatus for electrically connecting a twisted pair cable to a coax cable.

2. Description of the Prior Art

In the prior art, twisted pair cables are widely used as electrical conductors in the telecommunications or signal transmission industries. Also, coaxial cables are used for data and signal transmission. On occasion, it is desirable to perform an electrical connection between a twisted pair cable and a coax cable. To accomplish this connection, apparatus must be provided to effectively connect the cable conductors to the jack and (in some cases) to provide necessary circuitry to affect the electrical connection. One function of such circuitry is to provide impedance matching between the twisted pair cable and the coax conductors.

U.S. Pat. No. 4,693,537 to Dinsmore et al. dated Sep. 15, 1987 teaches an electrical connector having a connection end for connection to a BNC coax connector. Twisted pair cables are brought into the connector and terminated within the connector for a permanent connection to the connector.

It is an object of the present invention to provide a connector which can connect coax and twisted pair cables releasably.

SUMMARY OF THE INVENTION

According to a preferred embodiment of the present invention, a connector is provided comprising a housing sized to be manually engaged and extending from a first end to a second end. The first end is provided with a first connection mechanism for connection to a coax connector. The second end is provided with a second connection mechanism for connection to a twisted pair connector having exposed electrically conductive spring contacts. The first connection mechanism includes first internal components for releasably electrically connecting to a central coax conductor of the coax connector. The second connection mechanism includes second internal components for releasably electrically connecting to the exposed electrically conductive spring contact. A circuit is provided for electrically connecting the first and second internal components.

DESCRIPTION OF THE PREFERRED EMBODIMENT

Figure 1:
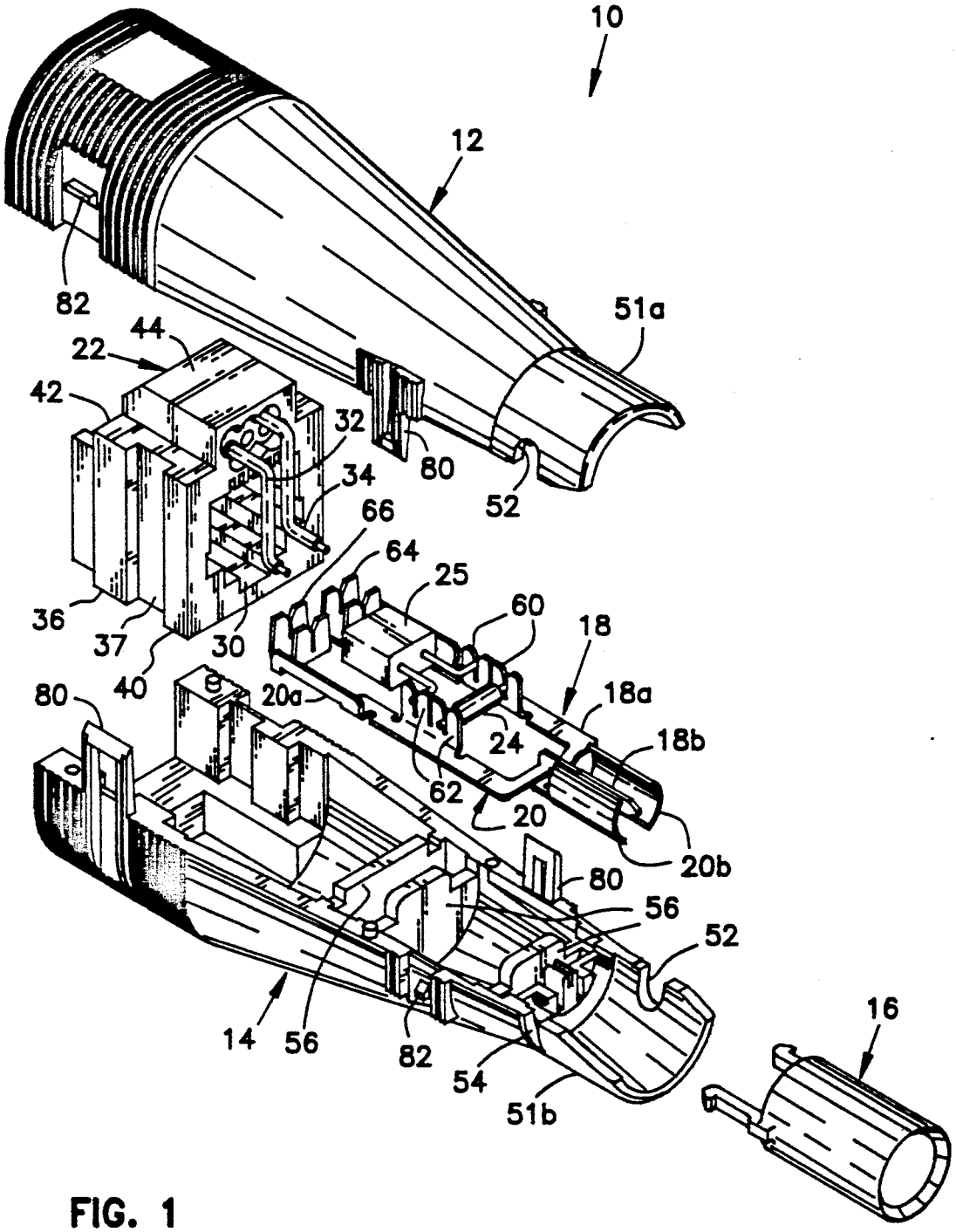
FIG. 1 is an exploded perspective view of the connector of the present invention.
Figure 2:
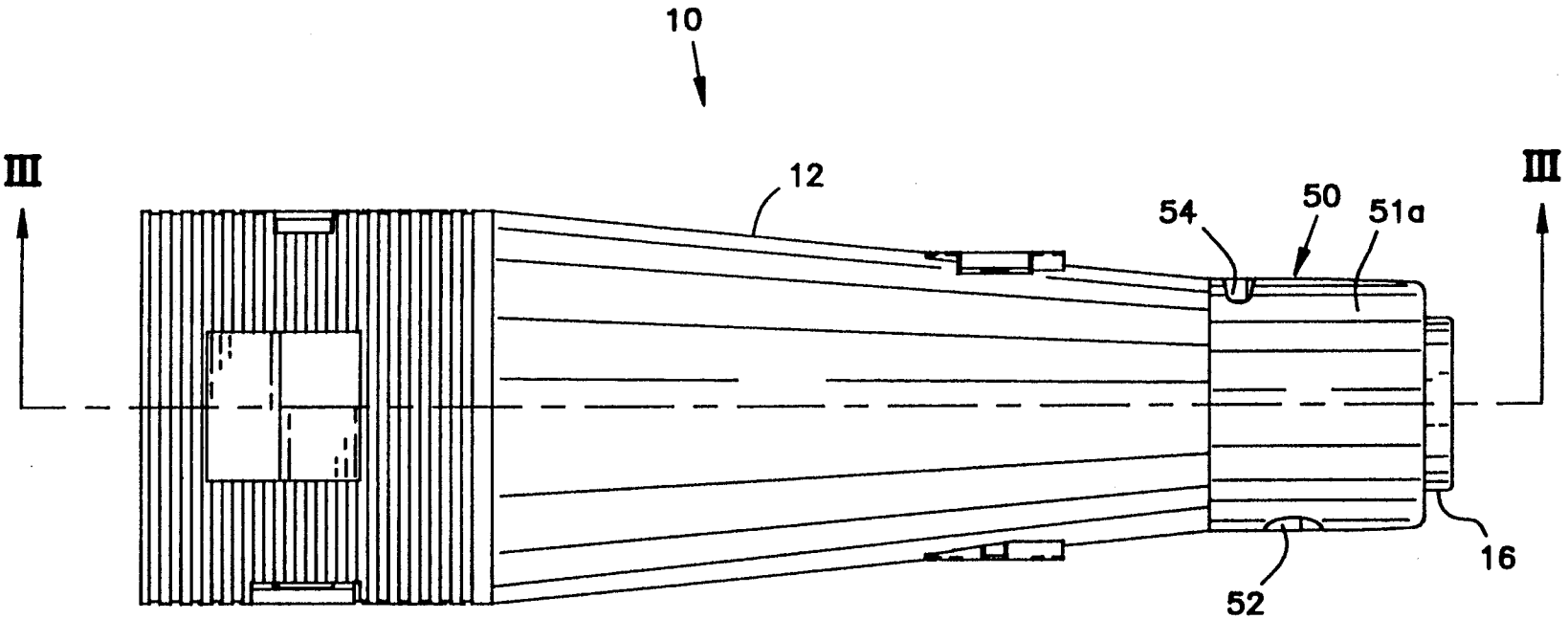
FIG. 2 is a top plan view of the connector of FIG. 1.

Referring now to the several drawing figures in which like elements are numbered identically throughout, a connector 10 is shown including a housing consisting of a first mating half 12 and a second mating half 14. In a preferred embodiment, each of mating halves 12,14 are injection molded plastic sized to be manually engaged and formed of dielectric material. The connector 10 further includes a plastic connection barrel 16, first and second intermediate conductors 18,20, an RJ-11 jack housing 22 and circuit elements 24,25 which, in a preferred embodiment, include a resister and a capacitor, respectively.

RJ-11 jack housing 22 is a commercially available item. RJ jacks are common in the telecommunication industries and are found in most dwellings as wall plugs for insertion of telephone conductors connecting a telephone to a wall plug. RJ-11 jacks have an internal cavity 30 which extends through the housing 22 and is sized to receive an RJ plug (not shown). Such plugs are standard in the telecommunications industry and have a plurality of exposed electrical spring contacts. The RJ jack housing 22 has spring contacts (not shown) disposed within cavity 30 for releasably and electrically connecting with the spring contacts of an RJ plug inserted within the cavity 30. RJ jack housings 22 are purchasable in the industry with a varying number of internal spring contacts. In a preferred embodiment, housing 22 will have two internal spring contacts. In such case, the housing 22 is commercially available with two extending electrical connection leads 32,34 referred to in the industry as a tip lead 32 and a ring lead 34.

Figure 5:
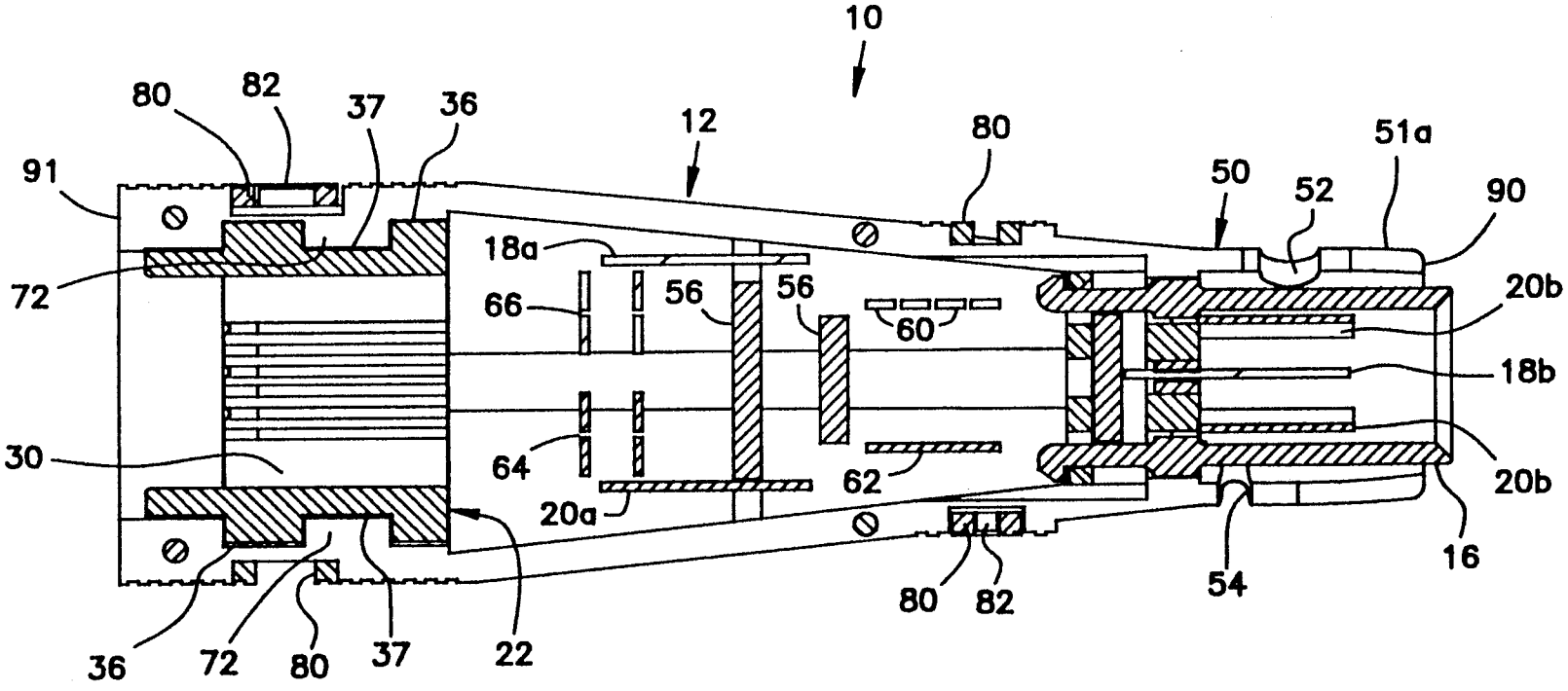
FIG. 5 is a view taken along line V—V of FIG. 4.

As shown in FIGS. 1 and 5, the commercially available standardized RJ jack housing has sidewalls 36 which are generally flat and include (in the view of FIG. 1) a vertically extending groove 37 (in the view of FIG. 1, only one sidewall 36 is shown). The bottom wall 40 is flat and the top wall 42 is provided with a protruding central portion 44.

The housing of connector 10 extends from a first end 90 to a second end 91. The first end 90 is provided with a first connection means 50 selected for releasable connection to a coax connector. In the embodiment shown, the connection means 50 is selected for connection to a BNC connector which is a commercially available standardized connector in the telecommunications industry for connection to a coax cable. The first connection means 50 includes an outer sleeve 51 formed by sleeve halves **51*a* and 51*b*. Each of sleeve halves 51*a* is identical and includes a side pocket 52 and an opposite slot 54. When the halves 51*a*,51*b* are joined together to conform a completed first connection means 50, the pockets 52 receive the posts (not shown) of a BNC-type connector. Slot 54 permits flexibility for attachment and detachment of the connector 50 to a BNC connector. It will be appreciated that a connector end such as end 50** forms no part of this invention per se and is more fully shown and described and commonly assigned U.S. Pat. No. 4,693,537, the specification and drawings of which are incorporated by reference.

Figure 3:
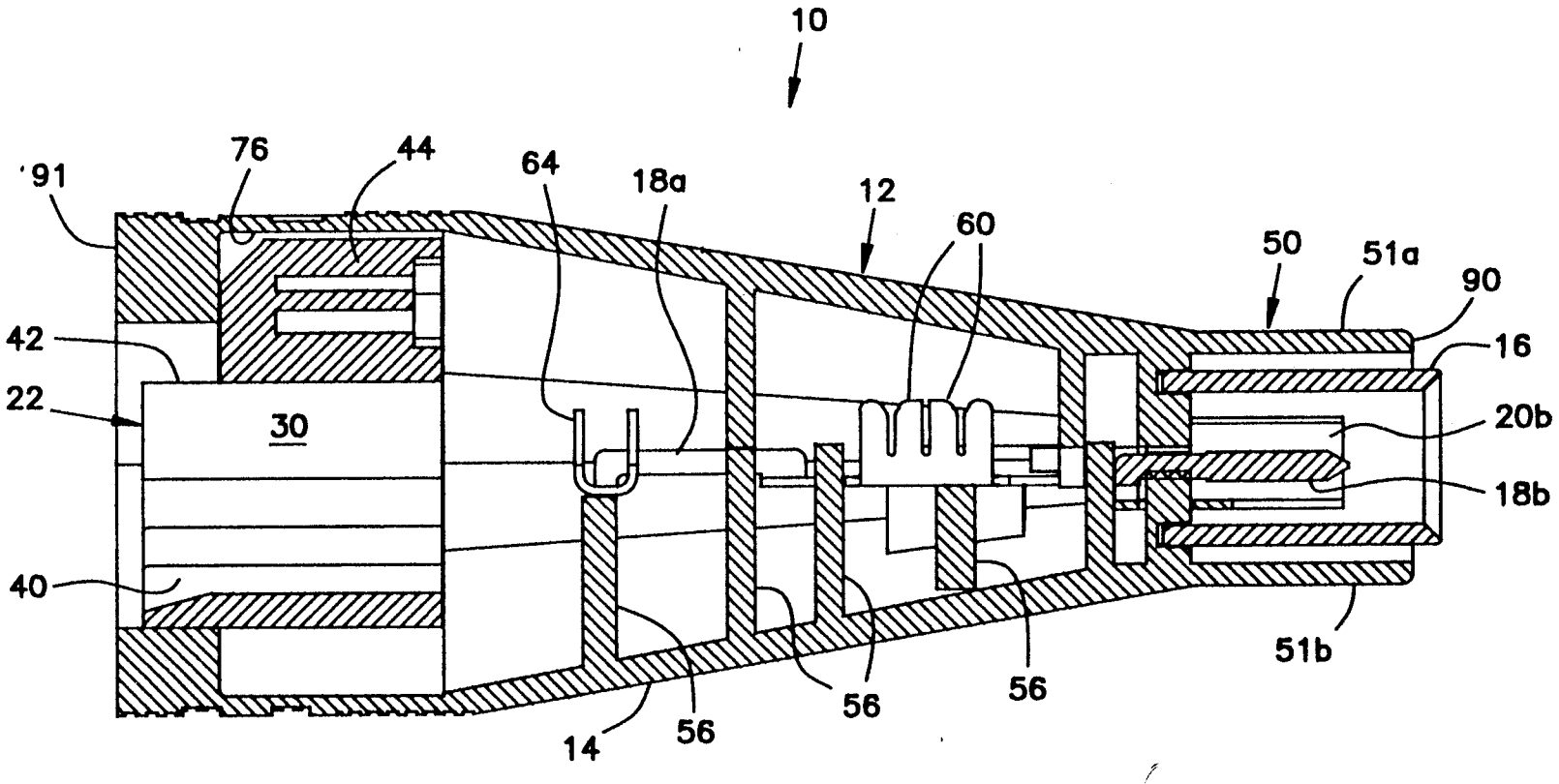
FIG. 3 is a view taken along line III—III of FIG. 2.
Figure 4:
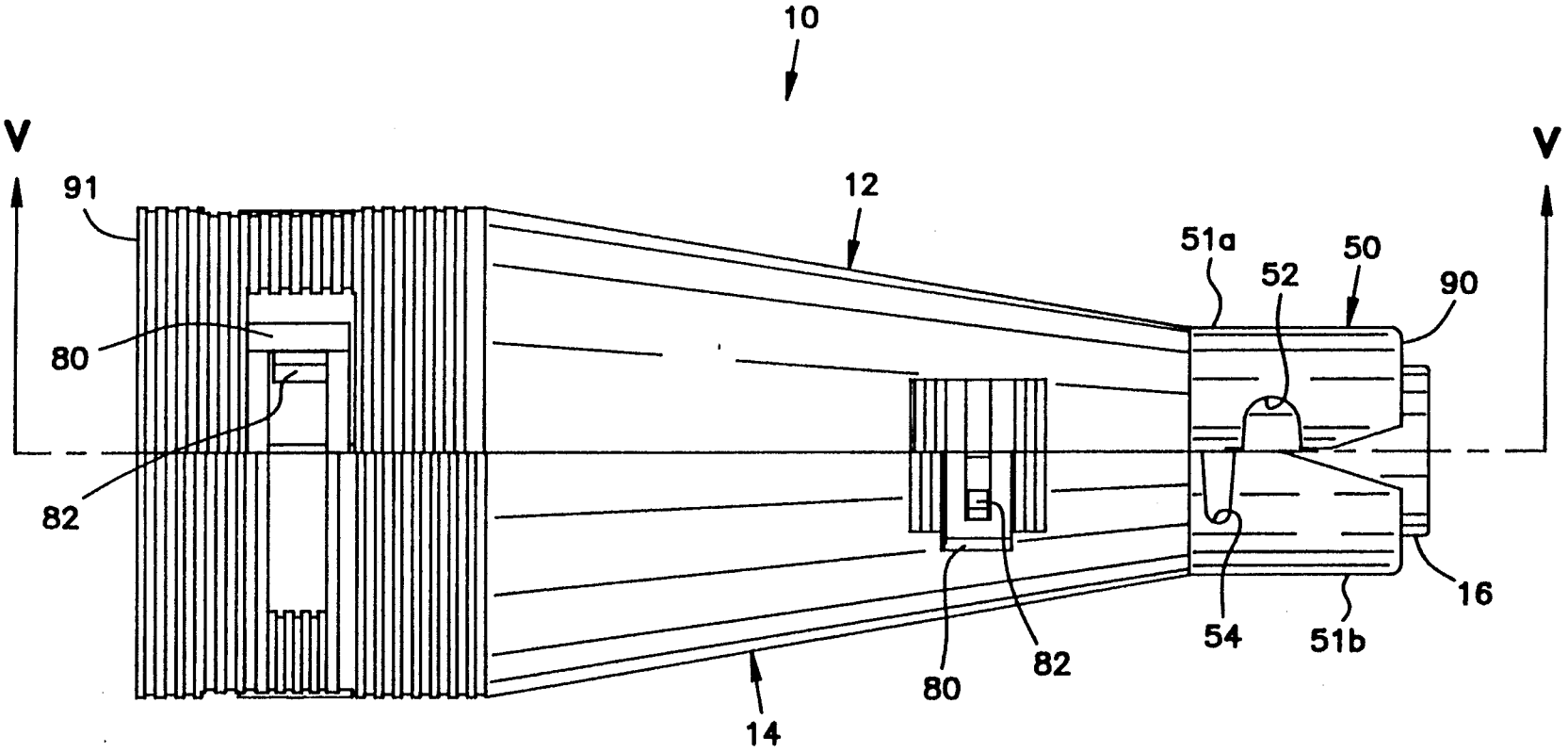
FIG. 4 is a side elevation view of the connector of FIG. 1.

Within housing halves 12 and 14, the intermediate conductors 18,20 are placed. The conductors 18,20 have main body portions **18*a*,20*a* which rest on supports 56 formed on body 14 (see FIG. 3). A pin 18*b* projects from body portion 18*a* and is positioned to extend axially within connector sleeve 50. Arcuate plates 20*b* are connected to body portion 20*a* and are positioned to surround pin 18*b* within sleeve 50. The pin 18*b*** is disposed to be received within the central conductor of a BNC connector attached to connecting end 50. The arcuate plates 20*b* are positioned to contact exposed contacts on a BNC connector. Barrel 16 provides an insulation surrounding arcuate plates 20*b*. Such a disposition of a central pin, arcuate plates and barrel is shown and described in the aforementioned U.S. Pat. No. 4,693,537.

Figure 7:
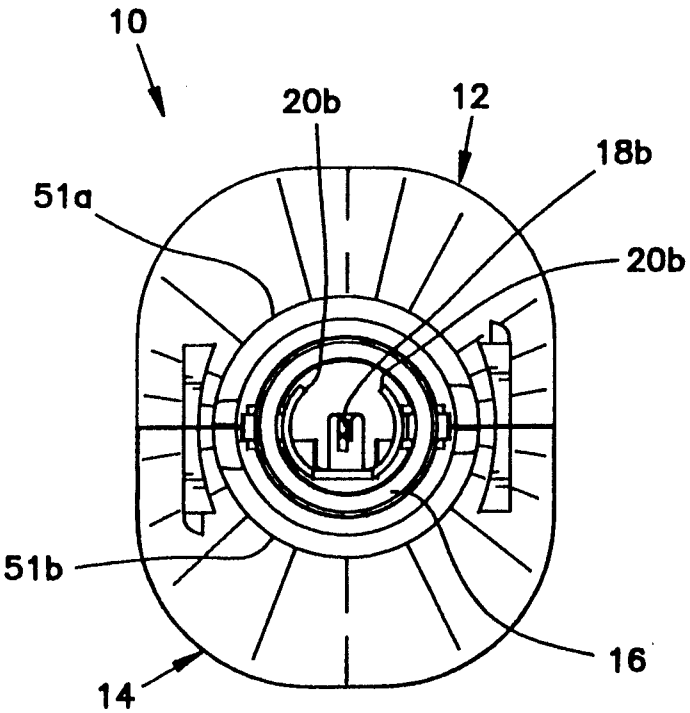
FIG. 7 is a front end elevation view of the connector of FIG. 1.
Figure 6:
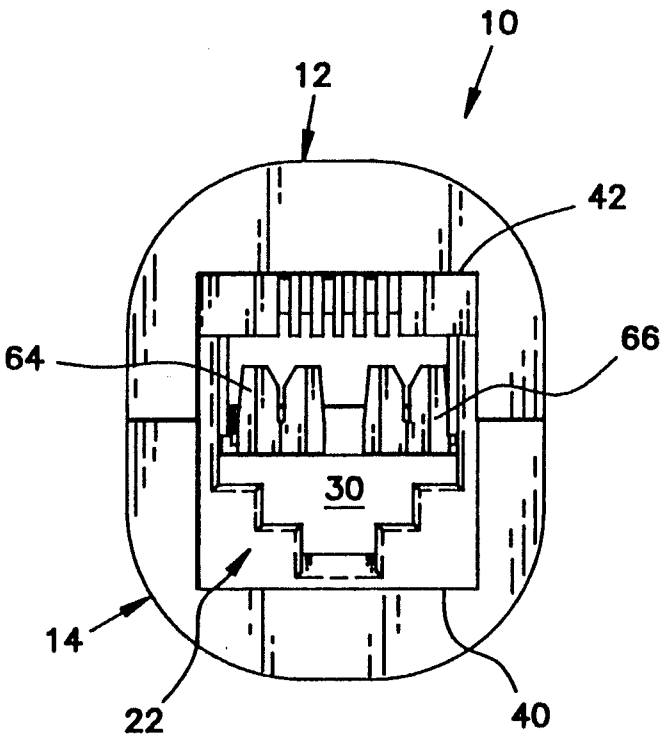
FIG. 6 is a rear end elevation view of the connector of FIG. 1.

Intermediate insulation displacement contacts 60,62 are disposed on body portions 18*a* and 20*a*. The insulation displacement contacts 60,62 are disposed to be in parallel alignment when intermediate conductors 18,20 are disposed within housing portion 14. The insulation displacement contacts 60,62 carry capacitor 25 and resister 24 such that intermediate conductors 18 and 20 are joined via a capacitance and a resistance in parallel. Such a circuit is shown in FIG. 7 of the aforementioned U.S. Pat. No. 4,693,537.

Second insulation displacement contacts 64,66 are disposed on the body portions 18*a*,20*a* on ends opposite 18*b* and 20*b*, respectively. The second insulation displacement contacts 64,66 receive the leads 34,32 from the RJ housing 22 to pierce the insulation of the leads 34,32 and provide electrical connection between the lead conductors and conductors 18,20.

As shown in the figures, the connector 10 has a second connection means at its second end 91. At end 91, housing 14 is provided with an interior posts 72 sized to be received and retained in groove 37. In housing half 12, a top recess 76 is provided to receive projection 44. Accordingly, RJ housing 22 may be slid into base 14 with posts 72 received within grooves 37. Upon connection of upper half 12 to lower half 14, the protrusion 44 is received within recess 76.

To connect upper half 12 to lower half 14, halves 12,14 have projecting side tabs 80 and locking tabs 82. Accordingly, connector halves 12,14 may be snap-fit together to securely capture conductors 18,20, RJ housing 22 and barrel 16.

With the invention thus described, twisted pair conductors may be directly connected to coax conductors by providing a twisted pair of conductors terminating at an RJ plug. The RJ plug may be inserted into RJ housing 22. The coax conductor can be terminated on a BNC connector which can be connected to connector 50. The circuit elements 24,25 provide impedance matching between the unshielded twisted pair and the coax cable.

As previously described, the circuit elements provide impedance matching. As an alternative to the circuit elements 24,25, a balun could be used. A balun is recognized by those in the industry as a toroidal shaped magnet with unbalanced windings. One set of windings is connected to the coax connection 50. The other set of connections is connected to the RJ housing 22. Additional modifications of the present invention include molding upper and lower halves of the RJ housing 22 directly into halves 12,14, respectively, with the halves 12,14 joined to define a completed RJ housing 22. A still further alternative of the present invention is to provide grounding shields for connection to the ground shield of the coax conductor.

From the foregoing detailed description of the present invention, it has been shown how the objects of the invention have been achieved in a preferred embodiment. Modifications and equivalents of the disclosed concepts are intended to be included within the scope of this invention.

What is claimed is:

1. A connector comprising:

a housing sized to be manually engaged and extending from a first end to a second end, said housing including first and second mating halves with snap-fit means for joining said halves;

said first end having a first connection means for connection to a coaxial connector upon attachment of said first end to said coaxial connector along a predetermined axis;

said second end having second connection means for connection to a twisted pair plug where said plug has exposed electrical conductive spring contacts;

said first connection means having first internal components for releasably electrically connecting to a central coax conductor of said coaxial connector upon connection of said first end to said coaxial connector;

an RJ jack having second internal components for releasably electrically connecting to said exposed spring contacts upon connection of said plug to said second connection means with said RJ jack disposed to receive a plug insert along said predetermined axis, said RJ secured within said housing upon said joining of said halves;

circuit means including impedance matching circuitry for electrically connecting said first and second internal component.

2. A connector according to claim 1 wherein said first connection means includes means for connecting said first end to a BNC connector.

3. A connector according to claim 1 wherein said housing is molded to include mating portions having internal cavities sized to receive and retain said RJ jack.

* * * * *